United States Patent [19]

Lambelet

[11] 4,160,426

[45] Jul. 10, 1979

[54] APPARATUS FOR CONTINUOUSLY MARKING AN INSULATED CONDUCTOR

[75] Inventor: Percy Lambelet, Garbsen, Fed. Rep. of Germany

[73] Assignee: Kabel-und Metallwerke Gutehoffnungshutte Aktiengesellschaft, Hanover, Fed. Rep. of Germany

[21] Appl. No.: 856,346

[22] Filed: Dec. 1, 1977

[30] Foreign Application Priority Data

Dec. 8, 1976 [DE] Fed. Rep. of Germany ..... 2655479

[51] Int. Cl.[2] ..... B05C 5/00

[52] U.S. Cl. ..... 118/323; 118/325; 118/DIG. 21

[58] Field of Search ..... 118/DIG. 21, 323, 325, 118/314; 239/DIG. 19

[56] References Cited

FOREIGN PATENT DOCUMENTS

| | | | |
|---|---|---|---|
| 240450 | 5/1965 | Austria | 118/325 |
| 950571 | 4/1961 | United Kingdom. | |
| 1034146 | 6/1966 | United Kingdom | 118/DIG. 21 |

OTHER PUBLICATIONS

Paper by G. Lehnert & J. V. McBride, "High Speed Bund Marking of Insulated Conductors," Pub. in Wire and Wire Products, Apr. 1964.

*Primary Examiner*—John P. McIntosh

*Attorney, Agent, or Firm*—Smyth, Pavitt, Siegemund, Jones & Martella

[57] ABSTRACT

An insulated conductor moves along two marking stations having tapered, oscillating nozzles made of magnesium, and whose tips are spaced from the conductors by about 20 to 30 millimeters; the ratio of the length of the nozzle to the spacing of the nozzle is about 6:5 to 7:5.

2 Claims, 2 Drawing Figures

15
16
12
11
11a
14
10
30
1
4
4
10'
17

17
21
18
25
24
16
d
l
r
1
17a
22
23
11
14'

APPARATUS FOR CONTINUOUSLY MARKING AN INSULATED CONDUCTOR

BACKGROUND OF THE INVENTION

The present invention relates to continuous high-speed band marking of insulated electrical conductors.

Communication and control cables are usually comprised of several or even many individual conductors. These conductors must be identified in some fashion and color-coding is a conventional technique which has been used with advantage for many years. In a typical example, a communication cable uses a number of conductor quads of which three conductors must be provided with different markings, while the fourth one may remain unmarked. The three conductors may be marked, for example, with different color bands placed regularly along the cable. Alternatively, groups of such bands are used to mark the cables, whereby the number of bands per group differs as a distinguishing marking feature. The band groups are likewise spaced regularly along and on the insulation. In a typical case, the spacing from band to band or from band group to band group may be a few centimeters or about one inch.

Several years ago a technique of band marking was developed and became known under the trademark "Colomat". This technique uses ink or dye jets which are directed towards the conductor but undergo periodic deflections so that a jet strikes the passing conductor only very briefly and inscribes thereby a half-band. As the ink-jet deflects up or down, it misses the cable and a length thereof passes by (still) unmarked. The next half-band is applied when the jet returns, and so forth. The jet oscillates, of course, in a plane extending transversely to the direction of the passing conductor. A similar oscillating ink or dye-jet is applied and directed towards the cable along the other side and operates in strict synchronism with the first one to provide the other half of a complete band in each instance. A marking system of this type is, for example, disclosed in British Pat. No. 950,571; (see Austrian Pat. No. 240,450) German Pat. No. 1,465,660, (see also British Pat. No. 1,034,146) and in a paper by G. Lehnert and J. V. McBride, "High speed Band Marking of Insulated Conductors", published in "Wire and Wire Products", April 1964.

This particular "Colomat" has been used with great success. Moreover, it was found to be of advantage to mark conductors in that fashion while the insulation is still hot and passes through a cooling zone, following, for example, extrusion of the insulation jacket onto the metal conductor. Ink and insulation dries together so as to ensure positive adhesion of the marking bands.

In recent years, however, the production line speed of conductors and cable has so greatly increased that the existing equipment for band marking just could not be operated at a commensurately higher speed. It was found, in particular that the jet tends to break up into droplets just about or even before striking the insulation, and the resulting half-band has rather poorly developed and fuzzy boundaries.

DESCRIPTION OF THE INVENTION

It is an object of the present invention to provide a new and improved apparatus for continually marking insulated conductors moving at high and very high production speeds with bands of sharply defined contrasting boundaries.

In accordance with the preferred embodiment of the present invention, it is suggested to provide a nozzle for producing an ink jet. The nozzle must have a straight internal duct and an outer contour which tapers from a relatively thick portion adjacent to a nozzle entrance towards a thin nozzle tip; the nozzle is positioned in relation to the axis through which the conductor to be marked passes longitudinally so that the nozzle tip has a distance of about one inch, preferably between 20 to 30 millimeters from that axis. The nozzle is being oscillated about a second axis which runs through the relatively thick portion of the nozzle, and the length of the nozzle measured between that oscillation axis and the tip is to be larger than the above-mentioned distance in that the ratio between the thus defined nozzle length and the aforedefined nozzle tip distance is between 6 and 7 to 5. It was found that a marking apparatus constructed in accordance with the features of the invention produces a coherent ink or dye jet. Due to the displacement of the nozzle tip from the oscillation axis, the deflection range which the nozzle must cover, does not have to be very large in order to obtain, in the plane of the conductor, a sufficiently large amplitude commensurate with the required band spacing. It can readily be seen that for a given band spacing, the conductor speed is directly proportional to the oscillating frequency of the nozzle and vice versa. Moreover, the particular nozzle configuration under utilization of a very light metal such as magnesium, prevents the generation of parasitic oscillations of the nozzle tip relative to the remainder of the nozzle body. Such oscillations, if superimposed upon the nozzle vibration as a whole, would produce a jittery ink jet.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows an insulated conductor 1 moving in the direction of the arrow. It is presumed that this conductor has just been provided with an insulative jacket and the jacket may still be hot. The particular arrangement shown in FIG. 1, therefore, may be included and be part of the cooling path for that jacket. Two band marking stations 10 and 10' are disposed on opposite sides along the running insulated conductor 1 for band marking that conductor.

Figure 1:
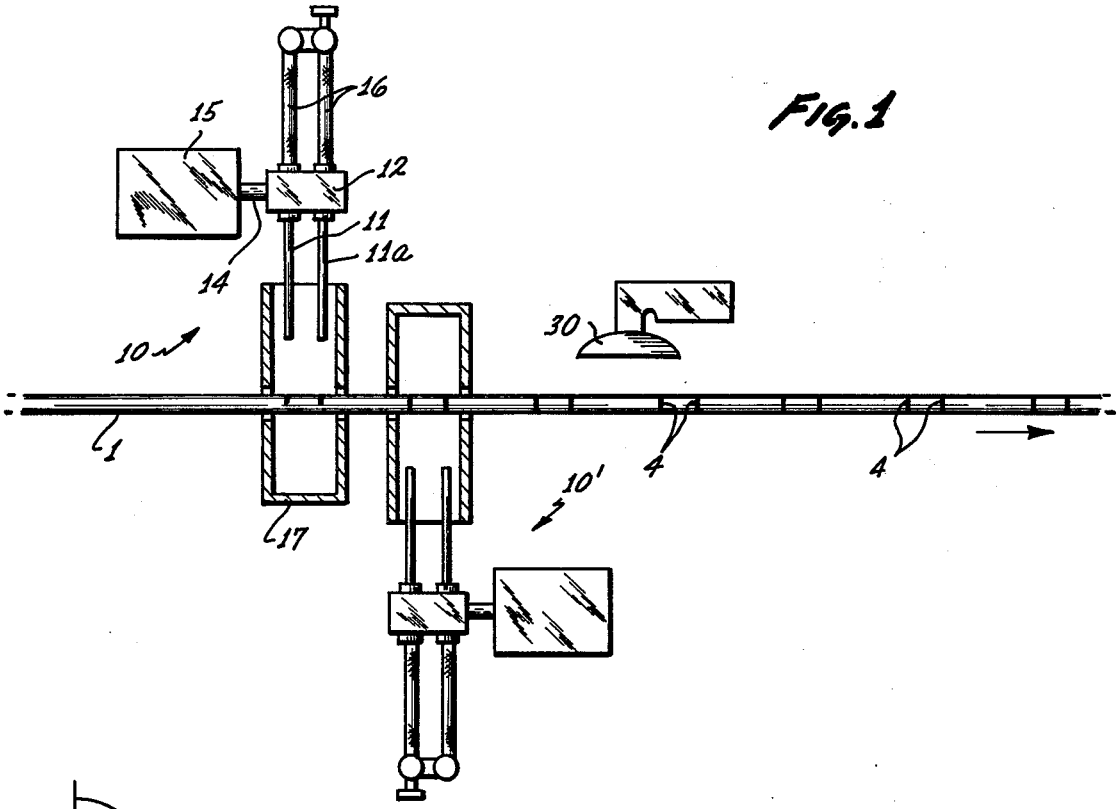
FIG. 1 is a schematic plane view of a color band marking system in accordance with and including the preferred embodiment of the present invention.

Each station provides a pair of approximately semicircular or half-band markings either of the same or different colors, and the operation is synchronized so that the half-bands as produced and provided by station 10, are completed by the station 10', and become circular bands 4. Otherwise, the two stations have, in fact, identical functions, and they are accordingly, similarly constructed. It is merely required to synchronize their operation, whereby it is basically immaterial which station is synchronized and which one is the master device. Conceivably, the station 10' is synchronized to the station 10, but they may well be operated by a common control providing suitable signals for operating the two stations so that they both operate in synchronism with each other.

For reasons of initially adjusting the operation of the two stations, a stroboscopic lamp 30 may be provided by means of which one observes registry of the two half-bands as produced. Utilization of such a stroboscopic lamp is necessary because the cable may pass through the stations at a speed in excess of 30 meters per second. Appropriate trimming adjustment, such as shifting the stations relative to each other along the cable, or adjusting the oscillation phases under continuous observation, is necessary initially to make sure that station 10' completes the bands in such a manner that the half-bands it produces are neatly aligned with the half-bands imprinted by station 10.

Each station such as 10 has a pair of extending or protruding nozzles 11, **11*a* mounted on and extending from a carrier 12 towards the conductor 1 and at right angles to the axis on which the conductor moves longitudinally. The carrier 12 is mounted on a shaft 14 which is the output shaft of a mechanical or, better, electromechanical vibrator or oscillator 15. This electro-magnetic oscillator rotates the shaft 14 back and forth over a particular angular range such as, for example, 90° with half of that range extending above and the other half below a horizontal plane running through the conductor 1**. Accordingly, this oscillator pivots the pair of nozzles up and down over that range.

The rear portion of each nozzle is connected to a flexible duct such as 16 which is connected to a source of dye or ink under pressure. The pressure is about 0.9 to 1 atmospheres above normal atmospheric pressure. In the illustrated case, it is presumed that the same color ink is being used; however, the two nozzles could well be connected to different ink sources of different colors if that is so desired.

Each of the nozzles 11 and **11*a*, and, of course, each of the corresponding nozzles in the station 10' ejects a stream or jet of ink towards the cable 1. As the nozzles move up and down, the ink streams each assume a sinusoidal pattern within divergent boundaries set by the angle through which the nozzles are being pivoted. The ink strikes the cable 1, and on each passage of each jet a half-band is being produced by the jet. The remainder of the ink is caught by a hood 17, or the like, and may be collected for being used again. Hood 17 has openings 17*a* through which the conductor 1** passes.

Figure 2:
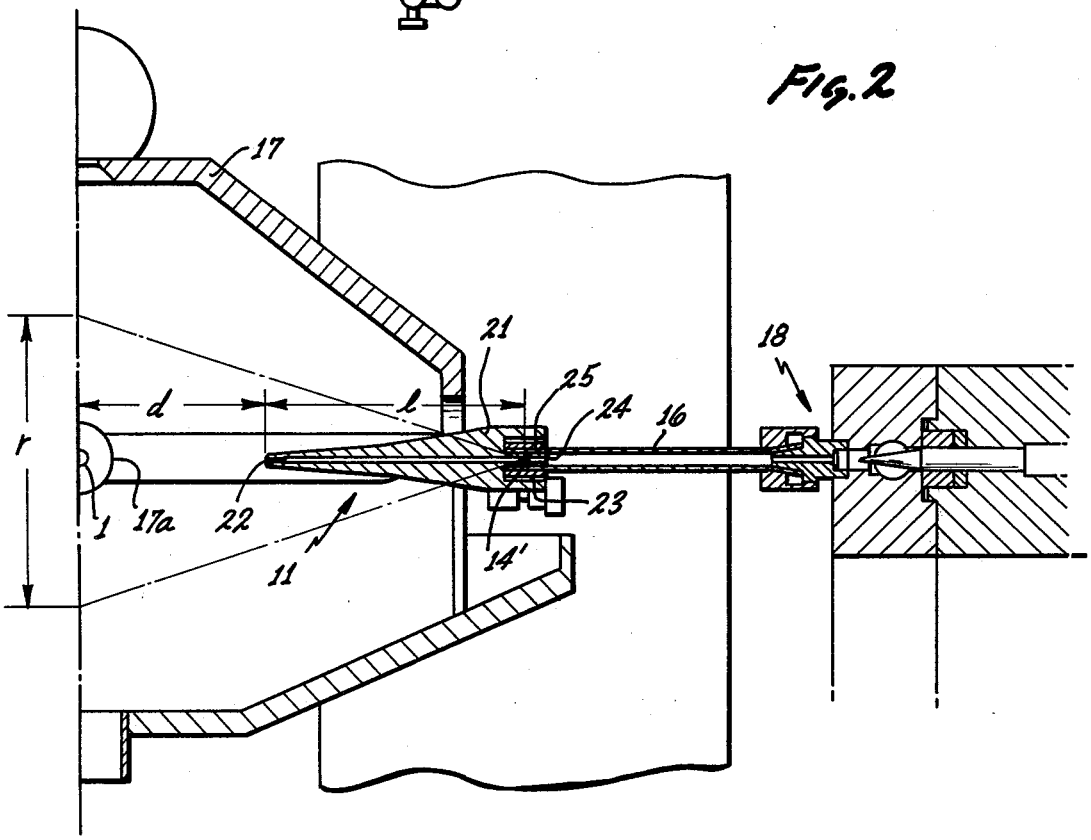
FIG. 2 is a section view on an enlarged scale of the detail as indicated by 2—2 in FIG. 1.

As shown in greater detail in FIG. 2, the nozzle such as 11 has a body 21 which tapers towards the exit or tip 22. The nozzle body is made of magnesium or aluminum and the tapered configuration ensures that, among other features, the nozzle is physically stable. Reference numeral 14' in FIG. 2 denotes the axis of the shaft 14; as the nozzle body swings about that axis, portions undergoing larger amplitude deflections are correspondingly lighter and smaller. The tip 22 is made as thin as possible. The distance between the tip 22 and the axis through which, and along which, the conductor 1 moves, is denoted by reference characterd, while the effective length of the oscillating nozzle measured from the tip 22 to the axis 14' is denoted by character 1.

The rear of the nozzle 11 has an annular recess 23 which receives the end of one of the hoses 16 which is slipped over a nipple 24; which could also be termed a recessed nipple. The central duct of the nipple 24 is, in fact, the rear end of the nozzle duct. A ring 25 clamps the hose onto the nipple. It should be briefly mentioned that the nozzles 11 and **11*a* may be integrated in that the body 21 has two such ducts and two such recessed nipples for connection to the two hoses as shown in FIG. 1**.

The rear ends of each of the hoses are connected to a valve and manifold structure 18 as shown in FIG. 2. Concerning the disposition and configuration of the nozzles, several important rules have to be observed. First of all, the amplitude of the oscillations undergone (particularly) by the nozzle tip, must be sufficiently large so that the sinusoidally deflected ink-jet is intercepted by the cable in the linear range of the oscillation. In other words, the range in the vertical plane through which the conductor passes, is the range in which the ink traverses that plane, and represents the peak-to-peak amplitude of the sinusoidal deflection of the ink in that plane. That amplitude is significantly larger than the diameter of the cable for the following reason. In order for the continuously moving cable to obtain uniformly-colored, uniformly-wide axial bands which are not oblique, or at least not visibly oblique to a plane transverse to the axis of the cable, the period of marking each band must be very short. More about the timing of this oscillation will be said below.

In addition, the cable should be spaced sufficiently far from the nozzle exit so that the jet impinging upon the cable is not spattered; in other words, the free jet must have already undergone some deceleration before striking the cable. These conditons, therefore, require the jet exit to be not too close to the cable. On the other hand, the ink jet must not separate or be torn into droplets before the jet strikes the cable; accordingly, the jet exit must neither be too far from the cable. It was found that the distance d should be between 20 and 30 millimeter, depending upon the diameter of the cable. While the smaller distance value has validity for a small cable diameter such as 1 millimeter, a distance d of one inch for a cable of 3 millimeter diameter can be regarded as a minimum; the distance d should actually be somewhat larger.

Turning now to the particular nozzle itself, the length l thereof defined as the distance between the oscillation axis **14*a* and the nozzle tip 22**, requires further consideration. In view of the fact that the ink jet deflection amplitude in the plane of the cable must be much larger than the diameter of the cable, one needs a significant deflection range for the vibrating nozzle. This is so because the bands must not be notably skewed or oblique as stated and the distance between adjacent band parts is established by the remainder of each oscillatory half-wave during which the ink bypasses the cable and swings up and returns or swings below and returns. The angular deflection range for the jet will be larger the closer one positions the cable to the oscillator axis, the other parameters being the same.

It must now be observed that the nozzle oscillates, for example, at a frequency of say 750 cps, commensurate with the speed of the cable between 5000 to 6000 feet per minute, which is between about 1.5 and not quite 2 kilometers per minute, or around 30 meters per second and, produces a band group spacing of 2 centimeters at that speed. It can readily be seen that the angular deflection range is the larger, the closer one places the vibration axis to the nozzle tip. Since the frequency is rather high, it is clearly of advantage to limit that angular range as much as possible, so that the axis in question should be rather far from the exit or tip 22.

On the other hand, the nozzle must not be too long and heavy because it swings and oscillates at a rather high speed and oscillation frequency. It was found that the use of aluminum, or still better, magnesium satisfies the weight requirement. A nozzle that is too thin and long tends to have its tips undergo independent, parasitic oscillations which must be avoided. That, in turn, is the reason for the tapered configuration. The tapered configuration offers, in addition, a favorable mass distribution to minimize the moment of inertia. Moreover, it is believed that a length limitation is set here which in terms of relative distance requires the distance or length l to be a little longer than the distance d. As stated earlier, the ratio of these lengths and distance values is to be about 6 or 7 to 5. It was further found that utilization of a relatively long and narrow nozzle duct imparts upon the ink flow a certain uniformity, so that the jet, as it leaves the tip 22, appears to be well concentrated and uniform and has little tendency to tear into droplets.

The invention is not limited to the embodiments described above but all changes and modifications thereof not constituting departures from the spirit and scope of the invention are intended to be included.

I claim:

1. Apparatus for continuously marking an insulated conductor which is being moved in a longitudinal direction and at a relatively high speed, comprising:

a nozzle made of light metal and having an internal, straight duct and an outer contour which tapers from a relatively thick portion adjacent to a nozzle entrance towards a thin nozzle tip;

means for positioning the nozzle in relation to a first axis in which the conductor is being moved longitudinally, so that the nozzle tip has a distance from the first axis of about 20 to 30 millimeters, the length of the nozzle between the tip and a second axis extending parallelly to the first axis being larger than first said distance, a ratio of said length to the said distance is between 6 and 7 to 5;

means connected for oscillating the nozzle about the second axis within a particular range; and means for feeding ink or dye to said nozzle entrance.

2. Apparatus as in claim 1, said nozzle being made of magnesium.

* * * * *